United States Patent [19]

Arav

[11] Patent Number: 4,561,379

[45] Date of Patent: Dec. 31, 1985

[54] PAPER FORMING

[75] Inventor: Ronnie A. Arav, Bolton, England

[73] Assignee: Beloit Corporation, Beloit, Wis.

[21] Appl. No.: 588,361

[22] Filed: Mar. 12, 1984

[30] Foreign Application Priority Data

Apr. 8, 1983 [GB] United Kingdom ..... 8309530

[51] Int. Cl.[4] ..... B05C 11/04

[52] U.S. Cl. ..... 118/126; 15/256.51; 118/261

[58] Field of Search ..... 118/126, 413, 261; 15/256.51

[56] References Cited

U.S. PATENT DOCUMENTS 4,169,425 10/1979 Wohrle ..... 118/665
4,220,113 9/1980 Wohlfeil ..... 118/126
4,334,766 6/1982 Sugiyama et al. ..... 15/256.51 X
4,405,661 9/1983 Alheid ..... 118/413 X

FOREIGN PATENT DOCUMENTS 1015127 12/1965 United Kingdom ..... 118/413

*Primary Examiner*—John P. McIntosh
*Attorney, Agent, or Firm*—Dirk J. Veneman; Gerald A. Mathews; Raymond W. Campbell

[57] ABSTRACT

Apparatus for supporting a coater blade as used in paper forming. The apparatus comprising a blade support, clamping means for locating the blade against the blade support, and a profile support engaging the coater blade. The profile support is an elongate plate-like member which is clamped adjacent one edge and whose other edge engages the coater blade. Adjustment means is provided to adjust the position of engagement of the profile support with the blade in a direction tangential to the plane of the coater blade. The adjustment being provided by a row of screws whose heads co-operate with the profile support and which engage threadingly with a mounting means for the profile support. Spring means acts in opposition to the screws.

2 Claims, 2 Drawing Figures

PAPER FORMING

DESCRIPTION

The present invention relates to apparatus for supporting a coater blade for use in paper forming or the like, which apparatus includes adjusting means for the coater blade.

In paper forming the coating weight on the paper is metered by a coating blade which is mounted in a support. Known coater blade supports are provided with adjustment in a plane perpendicular to the coater blade. In the other plane, tangential to the blade, the blade support is machined as straight as possible, but no adjustment is provided. Due to tolerance accumulation it is difficult to obtain the perfect straightness required and tests have established that adjustment of the coat weight at the coater blade is not solely affected by the perpendicular adjustment but is also affected by tangential adjustment.

According to the present invention there is provided apparatus for supporting a coater blade, comprising a blade support, clamping means for locating the coater blade against the blade support, a profile support engaging the coater blade and means mounting the profile support on the blade support, adjusting means being provided to adjust the position of engagement of the profile support with the blade in a direction tangential to the plane of the blade to thereby adjust the position of the blade.

Preferably, the profile support comprises an elongate plate-like member which is clamped adjacent one edge leaving the other edge projecting, which other edge engages the coater blade. Conveniently, the profile support is secured to a mounting bar by a clamp bar and the mounting bar is secured to the blade support. The means for adjusting the position of the profile support preferably comprises screw means which co-operates with the profile support adjacent the coater blade and engages threadingly with the mounting bar. Spring means acts in opposition to the adjusting screw means and is conveniently disposed between the profile support and the mounting bar. Rotation of the screw means adjusts the tangential position of the profile support and since the coater blade pivots on the profile support, the position of the coater blade is varied by adjustment of the tangential position of the profile support.

The present invention will now be described further, by way of example only, with reference to the accompanying drawings, in which.

Figure 1:
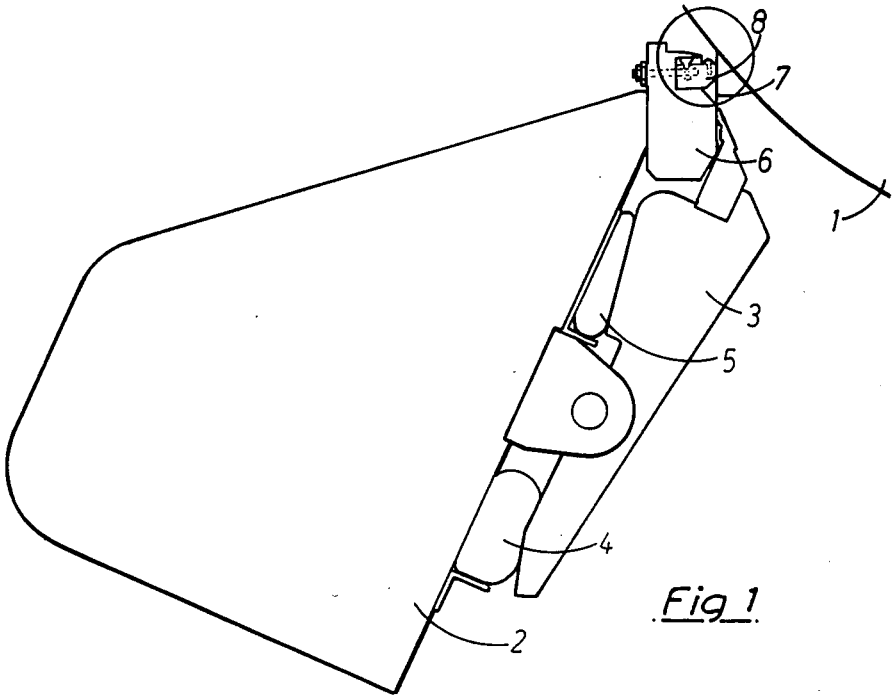
FIG. 1 is an end view showing mounting apparatus for a coater blade.

FIG. 1 shows a coater head body 2 having pivotally mounted thereon a clamp 3 which holds an elongate coater blade 7 against a blade support 6. The blade support 6 is secured to the coater head body 2. The tip of the coater blade 7 is adjusted so as to press against a backing roll—shown partially at 1. The position of the blade 7 is adjusted to achieve the desired coating weight on the paper which is supported by the backing roll 1. An air actuated clamp tube 4 is provided to pivot the clamp 3 in a direction to locate the blade 7 and an air actuated unclamp tube 5 is provided to pivot the clamp 3 in a direction to release the blade 7.

Figure 2:
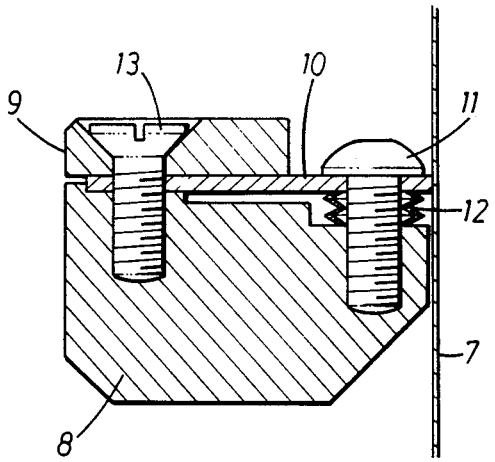
FIG. 2 is an enlarged detail of the circled portion of FIG. 1 showing the adjusting means for the coater blade.

The tangential blade support adjustment is shown in greater detail in FIG. 2 and comprises a profile support 10 in the form of an elongate plate-like member which is clamped adjacent one edge to a mounting bar 8 by a clamp bar 9 and screws 13 only one of which is shown. The mounting bar 8 is secured to the blade support 6 by screw threaded means. The other edge of the profile support 10 engages the blade 7 and provides a pivot point for the blade 7. The profile support is disposed in a plane substantially perpendicular to the blade 7 and is adjustable in a direction tangential to the blade 7 by a row of adjusting screws 11 only one of which can be seen in the end view. Each screw is received in a respective slot in the edge of the profile support. In the illustrated embodiment, the head of the screw 11 engages with the profile support and the shank is threadingly engaged with the bar 8. A spring 12, in the form of a spring washer or washers, is disposed between the profile support 10 and the bar 8. A downward movement of the profile support 10 is provided by the adjusting screws 11 and the opposing force exerted by the spring washers 12 provides the upward movement, i.e., the springs ensure that the profile support is urged upwardly into contact with the head of the adjusting screws.

The profile support 10 is preferably made of spring steel, or as an alternative stainless steel. It will be seen that a space exists between the profile support 10 and the bar 8 and this space is filled with sealing compound which has elastic properties. This seal prevents the space from filling up with coating material and at the same time is elastic enough to permit the adjustment to take place.

It will be appreciated that the described adjusting method using screws and springs may be replaced by other equivalent arrangements. The springs may be replaced by another set of adjusting screws, where a positive adjustment in both directions is required. Thus, 2 pairs of screws are formed which act in opposition to one another.

The tangential blade support adjustment has the advantages that; all manufacturing tolerances can be eliminated by adjusting the blade support, on site, after the coater head has been completely assembled; final adjustments can be made after all parts have been assembled together to compensate for all manufacturing composite tolerances, and absolute on-site-accuracy can be obtained; tangential errors are adjusted out directly, rather than using perpendicular adjustment which does not rectify the problem but compensates for one error by another.

The tangential adjustment provides direct rectification of errors in the same plane that they occur, leaving the perpendicular adjustors to correct errors in the perpendicular plane only. The arrangement ensures repeatability in varying working conditions where blade angles and blade loadings are changed with production requirements.

I claim:

1. Apparatus for supporting a coater blade comprising a blade support, clamping means for locating the coater blade against the blade support, a profile support including a plate-like member clamped adjacent one edge thereof leaving another edge projecting to engage the coater blade transversely therealong, mounting means comprising a mounting bar secured to the blade support, and a clamp bar securing the profile support to the mounting bar at one end thereof, said mounting means including a plurality of adjusting means comprising a plurality of screws, each, of which engages the profile support and mounting means to bias a corresponding portion of the profile support engaging the coater blade tangentially inwardly or outwardly along the extension of the blade surface relative to the tip edge of the blade.

2. Apparatus for supporting a coater blade comprising a blade support, clamping means for locating the coater blade against the blade support, a profile support having a portion engaging the coater blade transversely therealong, mounting means securing the profile support on the blade support, said mounting means including a plurality of adjusting means including a plurality of headed screws, each of which engages the profile support and mounting means to bias a corresponding portion of the profile support engaging the coater blade, and spring means corresponding to the plurality of screws, said spring means interposed between the profile support and the mounting means to urge the profile support into contact with the screw heads in opposition to the screws whereby selected ones of the adjusting means can be adjusted to move corresponding portions of the profile support, which engage the coater blade tangentially inwardly or outwardly along the extension of the blade surface relative to the tip edge of the blade.

* * * * *